United States Patent [19]

Lindstrom et al.

[11] 4,319,127

[45] Mar. 9, 1982

[54] ELECTRIC HEATING ELEMENTS

[75] Inventors: John A. Lindstrom; Donald M. Cunningham, both of Pittsburgh, Pa.

[73] Assignee: Emerson Electric Co., St. Louis, Mo.

[21] Appl. No.: 169,413

[22] Filed: Jul. 16, 1980

[51] Int. Cl.[3] ..... H05B 3/06

[52] U.S. Cl. ..... 219/523; 29/615; 219/335; 219/426; 219/535; 219/540; 219/541; 219/552; 338/238; 338/242

[58] Field of Search ..... 219/205, 331, 335, 336, 219/523, 540, 541, 544, 552, 421, 426, 530, 535; 29/61 N, 611, 613, 614, 615; 338/238, 239, 240, 241, 242

[56] References Cited

U.S. PATENT DOCUMENTS

| | | | |
|---|---|---|---|
| 2,036,788 | 4/1936 | Abbott | 338/238 |
| 2,767,288 | 10/1956 | Lennox | 338/238 |
| 2,849,590 | 8/1958 | Stiebel | 219/523 X |
| 2,875,312 | 2/1959 | Norton | 219/535 |
| 2,914,646 | 11/1959 | Denton | 338/242 X |
| 2,958,121 | 11/1960 | Toscher | 29/614 |
| 2,987,689 | 6/1961 | Lennox | 338/238 |
| 3,213,263 | 10/1965 | Steenbergen | 219/205 |
| 3,280,307 | 10/1966 | Ramey et al. | 219/540 |
| 3,310,657 | 3/1967 | Santoro, Jr. | 219/523 |
| 3,444,356 | 5/1969 | Finn | 219/331 |
| 3,720,155 | 3/1973 | Fritzsche | 219/523 X |
| 4,204,316 | 5/1980 | Hummel | 29/613 X |

FOREIGN PATENT DOCUMENTS

| | | | |
|---|---|---|---|
| 1019454 | 11/1957 | Fed. Rep. of Germany | 219/523 |
| 77099 | 10/1917 | Switzerland | 219/523 |

OTHER PUBLICATIONS

Chromalox Industrial Heating Products, Edwin L. Wiegand, Division of Emerson Electric Co., Stock Catalog, pp. 120–121.

*Primary Examiner*—Volodymyr Y. Mayewsky
*Attorney, Agent, or Firm*—Michael Williams

[57] ABSTRACT

Electric heating elements, particularly adapted for use in solder pots or in other uses wherein a substance is to be maintained in a molten or plastic condition, and commonly termed in such uses as over-the-side heaters. A conventional tubular heater is disposed within the central opening of a thick-wall metal pipe or tube, and the latter is swaged to reduce its cross-sectional size and thereby fit tightly about the tubular heater. Thereafter, the pipe and the heater therein, are bent in a pipe bender to any desired shape.

2 Claims, 4 Drawing Figures

FIG. 2.
FIG. 3.
FIG. 1.
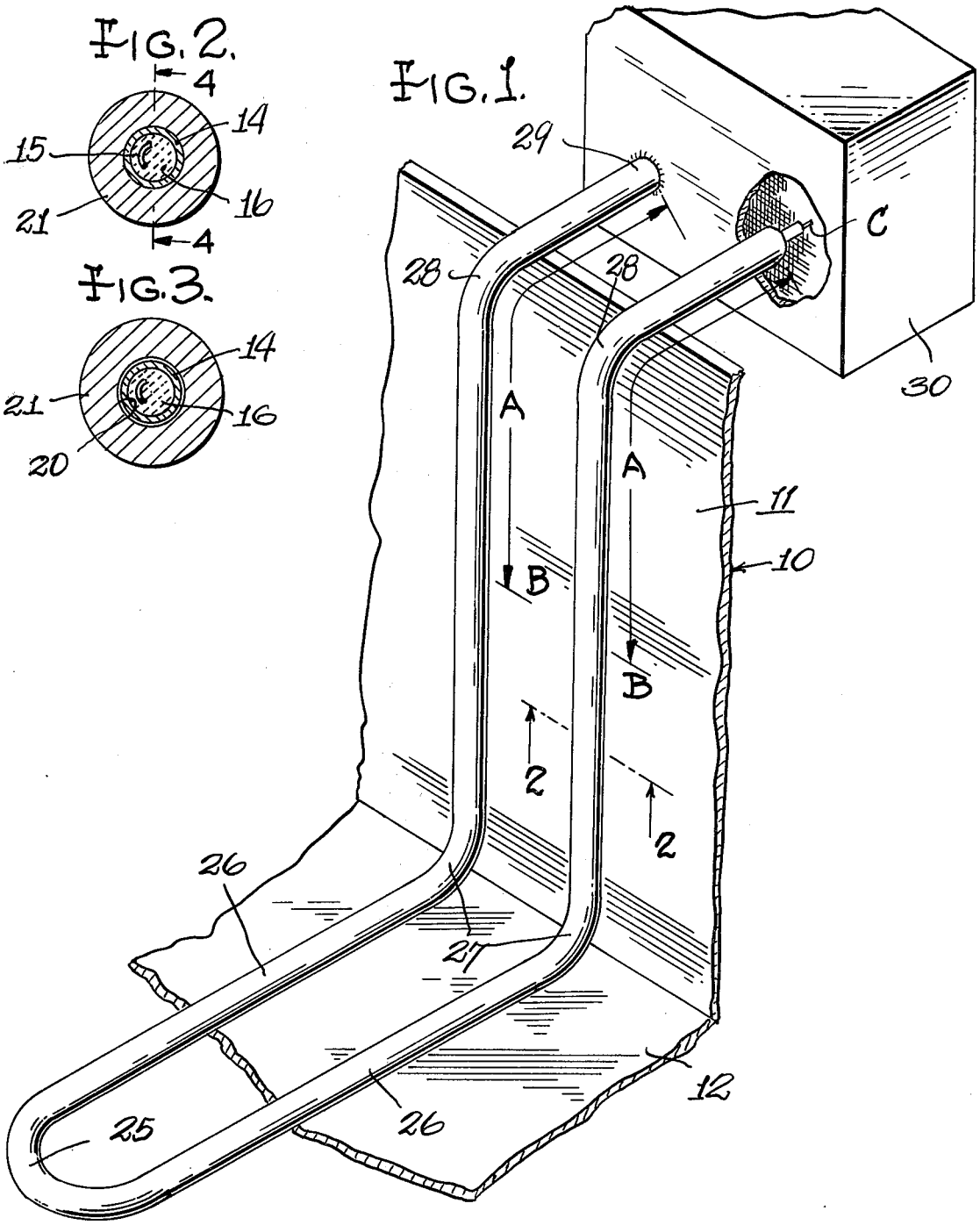
FIG. 4.
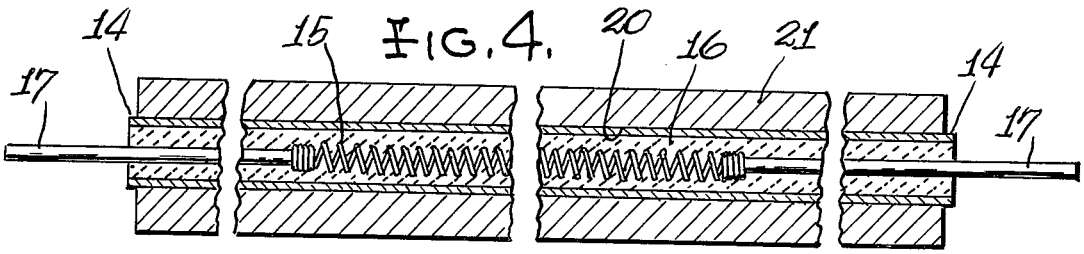

ELECTRIC HEATING ELEMENTS

BACKGROUND AND SUMMARY

Heaters heretofore manufactured for use in solder pots and the like consisted of a conventional tubular heater and an iron sheath cast about that portion of the tubular heater that is subject to contact with the molten metal to protect the sheath of the tubular heater from attack by the molten metal.

In this form of manufacture the tubular heater had to first be sent to the desired configuration which, in the case of the over-the-side heaters, consisted of an upper horizontal portion to be disposed over the side wall of the pot, and vertical and lower horizontal portions to be disposed within the pot.

Casting a protective iron sheath about the tubular heater involved considerable expense, both in equipment and labor, especially when the protective sheath was cast about a tubular heater that had been bent to a shape as disclosed above. First of all, the mold in which such casting operation was to be conducted was necessarily expensive because of the curvilinear cavity required. However, perhaps the most important disadvantage of the casting operation was the difficulty in maintaining the tubular heater in centered relation during the casting and solidifying operations. Frequently, the movement of the molten cast metal into the mold would shift the tubular heater off center or even the weight of the tubular heater, during the time the cast metal was solidifying would cause the tubular heater to sag to an off center condition.

When the tubular heater is in an off center position, the utility of the final product is severely affected because the protection shield around the heater is only as good as its cross sectional thickness, and if it is of nonuniform thickness, the protection will be only as good as the thinnest cross section.

Some prior art patents, such as U.S. Pat. No. 2,036,788, issued to C. C. Abbott on Apr. 7, 1936, and U.S. Pat. No. 2,987,689, issued to T. H. Lennox on June 6, 1961, disclose a tubular heater with an extra outer sheath, but these heaters would be unsuitable for molten metal pot heating applications since the molten metal would soon eat through the outer sheath and then through the inner sheath, and thereby cause destruction of the heater.

Our invention provides heavy wall protection for a tubular heater, without the expense and disadvantages of the molding operation heretofore described. Low cost manufacture is effected since a standard, rectilinear tubular unit may be used, this unit being slipped into the center opening in a thick wall pipe or tube which is substantially coextensive with the tubular unit. The pipe is side pressed or rolled, or by any other suitable means is reduced in diameter to thereby tightly fit about the tubular unit. Thereafter, the assembly may be bent to any desired configuration in a pipe bender of suitable construction, and the assembly is ready for use.

DESCRIPTION OF THE DRAWING

In the drawing accompanying this specification and forming a part of this application there is shown, for purpose of illustration, an embodiment which our invention may assume, and in this drawing:

FIG. 1 is a perspective view of a heater of our invention, shown in over-the-side use with a tank which is fragmentarily shown, FIG. 2 is a cross sectional view corresponding to the line 2—2 of FIG. 1, FIG. 3 is a sectional view similar to FIG. 2 but showing the protective pipe before transverse reduction, and FIG. 4 is a fragmentary, longitudinal sectional view corresponding to the line 4—4 of FIG. 2.

DESCRIPTION OF THE PREFERRED EMBODIMENT

As disclosed in FIG. 1 the heater of our invention is shown in use in an over-the-side manner with respect to a tank or pot 10, having side walls 11 and a bottom 12. If the tank is a solder pot, it will contain molten lead or zinc, and the improved heater is for the purpose of maintaining the metal in molten condition and, in some uses, for actually reducing the metal to molten condition.

Our invention utilizes a standard sheathed tubular heater, such as shown in the Stock Catalog, CHROMALOX Industrial Heating Products, of the Edwin L. Wiegand Division of the Emerson Electric Co., at pages 120 and 121. Briefly, such heaters comprise a metal sheath 14 which may be of plain cold rolled steel for economy purposes, although any other suitable metal may be used, such as INCOLOY, stainless steek, copper or the like. A helically coiled resistance wire 15 is held centered within the sheath 14 by compacted refractory material 16. Metal terminal pins 17, commonly of cold rolled steel and nickel plated, are mechanically and electrically connected to opposite ends of the resistance wire 15, and extend outwardly of the sheath for connection to a source of electrical energy.

The standard tubular heater is rectilinear and manufactured in various lengths. For our invention a length is chosen to accommodate the use to which the final heater will be put. The heater is simply inserted axially into the central opening 20 in a metal pipe or heavy wall tube 21. As seen in FIGS. 2–4, the wall thickness of the pipe or tube 21 is considerably greater than the wall thickness of the heater sheath 14. In one example, the wall thickness of the sheath 14 is about 0.035 inches (about 0.8500 millimeters), whereas the wall thickness of the pipe or tube 21 is about 0.125 inches (about 3.1750 millimeters), showing that the latter wall thickness is more than three times that of the former wall thickness. The pipe or tube 21 may have a greater wall thickness and this probably is limited by the bending ability of a standard pipe bender. In FIG. 2 the wall thickness of the pipe 21 is about five times that of the sheath 14.

The diameter of the central opening 20 is slightly greater than the outside diameter of the sheath 14 so that the latter may be freely slid into the central opening to proper position. Thereafter the pipe or tube is subjected to a side pressing or rolling operation to reduce its diameter sufficiently to tightly fit around the sheath 14 in metal-to-metal contact therewith. Then the assembly is placed within a standard pipe bender (not shown) and the bight 25 is first formed to configure the heating assembly to hairpin shape. Thereafter, the legs 26—26 of the assembly are formed with the bends 27 and 28 in the event the assembly is to be used as an over-the-side heater. Usually the ends of the legs 26—26 are welded or brazed into holes in a terminal box 30.

Since it would be a waste of energy to heat the heater all the way to the terminal box 30, and also because this could be dangerous, the length designated by the dimension A in FIG. 1 would represent cold sections of the heater assembly. In such case the resistance wire will terminate at points B, with the terminal pins long and extending from the resistance wire at B to extension within the terminal box, as seen at C in FIG. 1, for connection to conductors leading from a source of electrical energy. Alternately, if strictly standard tubular heaters are desired to be employed, the terminal pins of a standard unit may terminate at points B and current conductors (not shown) may be connected to the terminal pins and extend through the central opening 20 in the pipe 21 and outwardly thereof and into the terminal box.

I claim:

1. An electric heating assembly having a portion adapted to be immersed in molten metal which is contained within a tank, for maintaining said metal in molten condition, comprising:

an elongated, rectilinear electric heating element having a tubular, heat-conducting metal sheath of a wall thickness of about 0.035 inches, a resistor centrally of and extending lengthwise within said sheath, and compacted refractory material within said sheath for electrically insulating said resistor from said sheath, but conducting heat from said resistor to said sheath, an elongated, rectilinear metal tube having a central longitudinally-extending opening of a transverse shape complementary to the transverse shape of said sheath and of a transverse size slightly larger than the transverse size of said sheath, said tube opening closely receiving said sheath and being substantially coextensive with at least a greater portion of said sheath, said tube having a wall thickness of at least 0.125 inches, and being laterally compressed upon said sheath while both are in rectilinear form to fit around said sheath in metal-to-metal heat-transfer contact to produce a manufactured assembly in an initial form, said assembly being subsequently bent to specific curvilinear formation for proper insertion into said tank with the protected portion of said sheath arranged for immersion within said molten metal, and said tube being of a metal having a higher melting point than the temperature of the molten metal in said tank, and providing a substantial and uniform wall around said tube to shield the latter from destructive attack by said molten metal.

2. The construction according to claim 1 wherein said assembly is bent for over-the-wall use with said tank, wherein a major intermediate portion of said assembly is of hairpin formation having a bight portion and a first part of the legs adapted to be near the bottom of said tank and a second part of the said legs at an angle to said first part and extending upwardly from said tank bottom to the top of said tank, and a third part of said legs at an angle to said second part to extend over the wall of said tank.

* * * * *